US010397692B2

(12) United States Patent
Janes

(10) Patent No.: US 10,397,692 B2
(45) Date of Patent: Aug. 27, 2019

(54) MULTI-DRIVER ARRAY AUDIO SPEAKER SYSTEM

(71) Applicant: Thomas A. Janes, Hinsdale, IL (US)

(72) Inventor: Thomas A. Janes, Hinsdale, IL (US)

( * ) Notice: Subject to any disclaimer, the term of this patent is extended or adjusted under 35 U.S.C. 154(b) by 128 days.

(21) Appl. No.: 15/452,974

(22) Filed: Mar. 8, 2017

(65) Prior Publication Data

US 2018/0262836 A1 Sep. 13, 2018

(51) Int. Cl.

| | |
|---|---|
| ***H04R 1/26*** | (2006.01) |
| *H04R 1/28* | (2006.01) |
| *H04R 1/40* | (2006.01) |

(52) U.S. Cl.

CPC ..... *H04R 1/26* (2013.01); *H04R 1/2842* (2013.01); *H04R 1/403* (2013.01)

(58) Field of Classification Search

CPC ..... H04R 3/14; H04R 1/26; H04R 1/2826; H04R 1/2857; H04R 3/04

See application file for complete search history.

(56) References Cited

U.S. PATENT DOCUMENTS

| | | | | |
|---|---|---|---|---|
| 2,602,860 | A | 7/1952 | Stewart | 381/335 |
| 3,052,758 | A | 9/1962 | Berry | 381/120 |
| 3,299,206 | A | 1/1967 | Klepper | 381/387 |
| 3,947,635 | A | 3/1976 | Frankman | 381/301 |
| 4,267,405 | A | 5/1981 | Russell | 381/305 |
| 4,399,328 | A | 8/1983 | Franssen | 381/1 |
| 4,706,290 | A * | 11/1987 | Lin | G01R 23/20 381/58 |
| 4,940,108 | A | 7/1990 | Selby | 181/145 |
| 5,309,518 | A | 5/1994 | Ickler | 381/336 |
| 6,801,631 | B1 | 10/2004 | North | 381/336 |
| 6,961,438 | B1 | 11/2005 | Fujita | 381/182 |
| 7,260,228 | B2 * | 8/2007 | Hughes | H04R 1/403 381/182 |
| 7,319,767 | B2 | 1/2008 | Fidlin | 381/182 |
| 7,447,316 | B2 | 11/2008 | Nakamura | 381/17 |
| 7,684,574 | B2 | 3/2010 | Keele | 381/160 |
| 7,787,645 | B2 | 8/2010 | Clair | 381/182 |
| 8,135,158 | B2 | 3/2012 | Fincham | 381/387 |
| 8,144,900 | B2 * | 3/2012 | Oxford | H04R 1/403 181/145 |
| 8,238,588 | B2 | 8/2012 | Meyer | 381/182 |

* cited by examiner

*Primary Examiner* — Regina N Holder
(74) *Attorney, Agent, or Firm* — Niro McAndrews, LLP

(57) ABSTRACT

The speaker system disclosed includes multiple closely spaced drivers in a column matrix format. Using signal processing and pairing of the drivers, the speaker system optimally combines acoustic output and maintains the benefits of a single column vertical array while achieving improved low frequency sound production by coupling speakers through spatial and frequency alignment. The full frequency range of an audio signal is provided to a first set of drivers while a low frequency band of the audio signal is provided to a second set of drivers. The horizontal centers of the two adjacent sets of drivers are such that the signal wavelength provided to the second set of drivers is at least twice the separation distance between transducer acoustic centers. By providing a continuous range of signal to at least one driver set, and proper frequency management of the second set, crossover artifacts are substantially minimized while the benefits of coupled drivers are optimized.

25 Claims, 10 Drawing Sheets

Fig. 10a
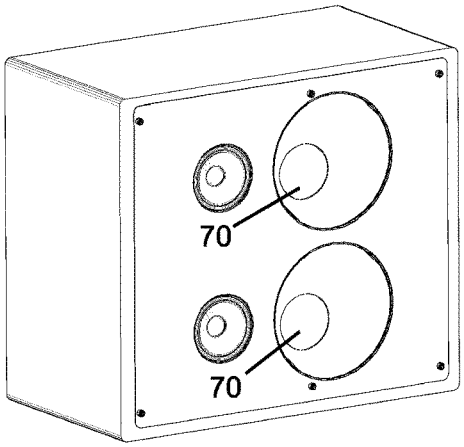
Fig. 10b
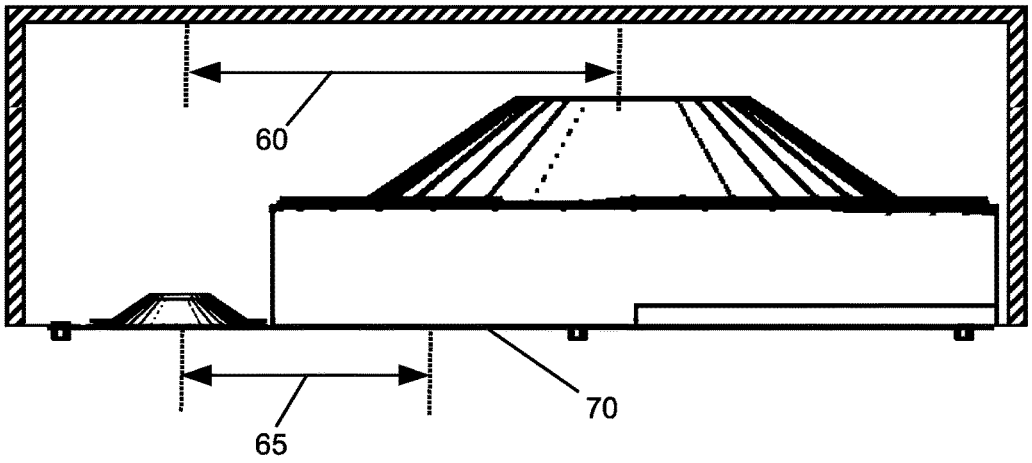
Fig. 11
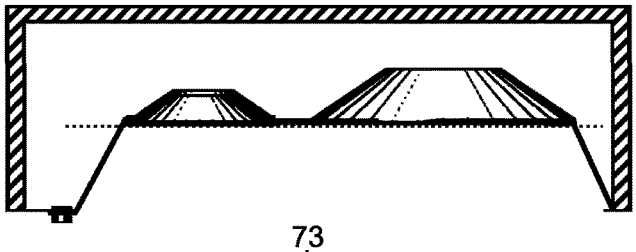
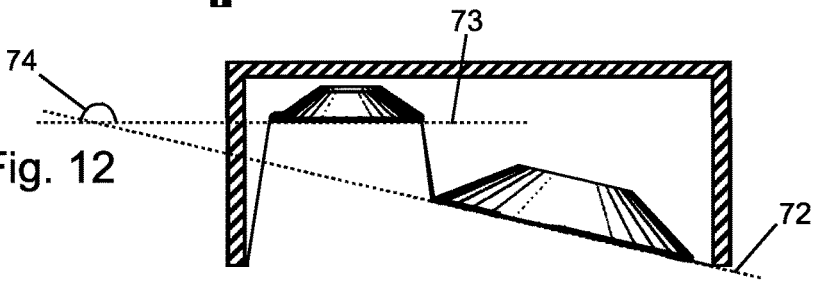
Fig. 12

MULTI-DRIVER ARRAY AUDIO SPEAKER SYSTEM

FIELD OF THE INVENTION

The present invention relates generally to a loudspeaker system with transducers optimally aligned in space and frequency response coupling to create a large effective sound radiation area for reproducing low frequencies, while maintaining the benefits of a small driver vertical array.

BACKGROUND OF THE INVENTION

Audio transducers provide varying frequency responses based on their physical characteristics, with larger transducers providing a greater response at lower frequencies while smaller transducers provide a more capable response at higher frequencies. With the general frequency range of human hearing spanning three orders of magnitude (approximately 20 Hz to 20 kHz), a single transducer generally cannot faithfully reproduce the full spectrum of audible sound.

Speaker systems that use multiple transducers will often send the low frequency portion of an input signal to a large transducer (or woofer) and the high frequency portion of the input signal to a small transducer (or tweeter). An example of such a system is shown in U.S. Pat. No. 3,947,635, the contents of which are herein incorporated by reference. While dividing an input signal and separately providing it to different sized transducers allows the speaker system to reproduce both high and low sound frequencies, the process introduces audio artifacts that diminish the sound quality. In particular, sound reproduction in the frequency range near the crossover point suffers, as the signal is transitioned from one transducer to another. This is a less than perfect transition, as both transducers share and reproduce the same signal, causing discontinuity, phase shift, frequency peaks and dips occurring within the human voice range (approximately 300-3000 Hz) and across the critical hearing sensitivity range of approximately 1 kHz-5 kHz (Fletcher-Munson/ISO 226-2003 revisions equal-loudness contours). Additionally problematic is the destructive lobbing within this sensitive hearing range due to small frequency wavelengths relative to the distance between the acoustic centers of the woofer and tweeter.

Single column line arrays are loudspeaker systems made up of a number of usually identical transducers mounted in a line and fed an in-phase signal, to create a near-line source of sound. The transducers constructively interfere with each other to send sound waves farther than traditional loudspeakers, and with a more evenly distributed sound output pattern. Vertical columns provide a narrow vertical output pattern that is useful for minimizing reflections (ceiling and floor) and as such attenuates multiple sound arrivals which cause discontinuity and degrade intelligibility.

SUMMARY OF THE INVENTION

A speaker system is disclosed that includes multiple closely spaced drivers in a column matrix format. Using signal processing and pairing of the drivers, the speaker system optimally combines acoustic output and maintains the benefits of a single column vertical array while achieving improved low frequency sound production by coupling speakers through spatial and frequency alignment. The full frequency range of an audio signal is provided to a first set of drivers while a low frequency band of the audio signal is provided to a second set of drivers. The horizontal centers of the two adjacent sets of drivers are such that the signal wavelength provided to the second set of drivers is at least twice the separation distance between transducer acoustic centers. By providing a continuous range of signal to at least one driver set, and proper frequency management of the second set, crossover artifacts are substantially minimized while the benefits of coupled drivers are optimized.

BRIEF DESCRIPTION OF THE DRAWINGS

Preferred embodiments are described with reference to the following drawings, wherein:

FIG. 10*a* shows a perspective view of a dual vertical column system wherein the output of the second vertical column is vented to an output location adjacent to the first vertical column.

FIG. 10*b* shows top plan cross sectional view of the speaker system of FIG. 10*a*.

FIG. 11 shows a first example of a speaker system used with a waveguide.

FIG. 12 shows a second example of a speaker system used with a waveguide.

DETAILED DESCRIPTION

Figure 1:
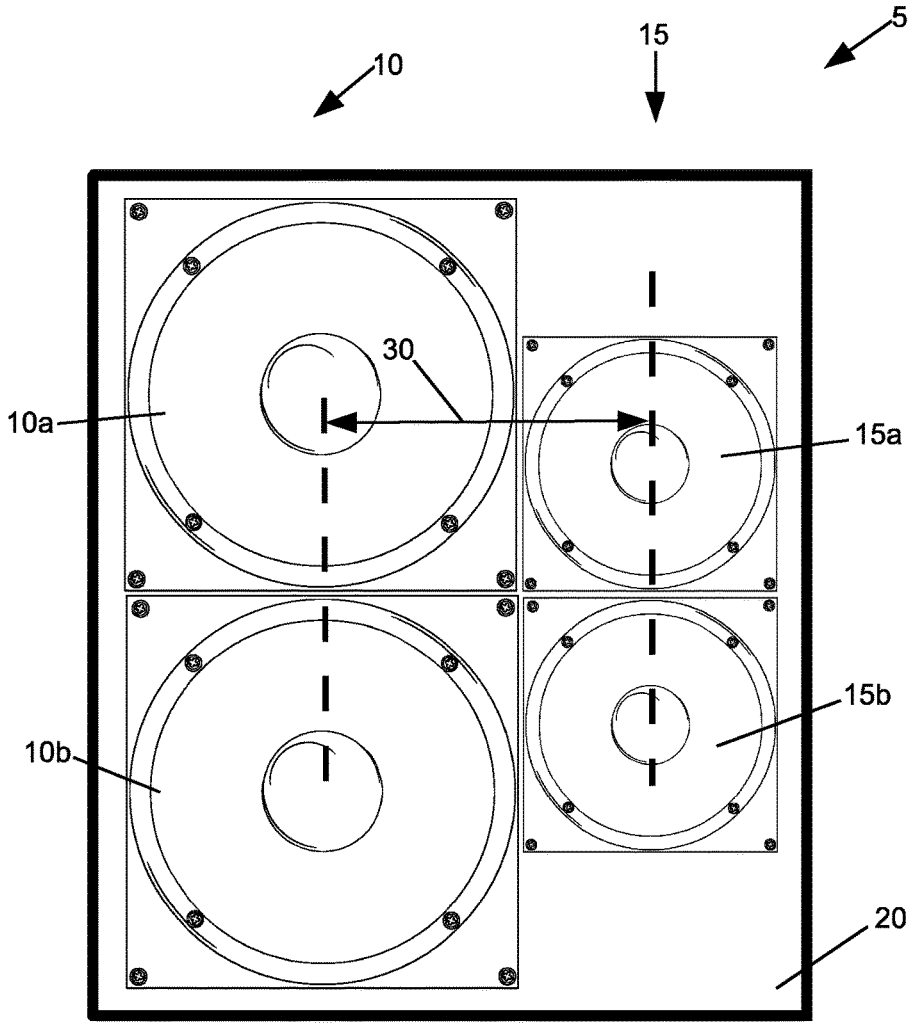
FIG. 1 is a front view of a dual column having a first vertical column with large transducers and a second vertical column with small transducers.

The disclosed speaker system provides a clean audio presentation with emphasis on the vocal frequency range while attenuating crossover wave interference across the critical ear sensitivity range (1 kHz to 5 kHz) per Fletcher- Munson/ISO 226-2003 revisions equal-loudness contours. The speaker system disclosed includes multiple closely spaced transducers in a column matrix format. Using signal processing and pairing of the transducers, the speaker system maintains the benefits of a single column while achieving improved low frequency sound production by coupling speakers through spatial and frequency alignment. The terms transducer and driver are herein used interchangeably.

A broad frequency range of an audio signal is provided to a set of drivers while a low frequency band of the audio signal is provided to an adjacent set of drivers. The horizontal centers of the two adjacent sets of drivers are such that the separation between driver acoustical centers (dc) is less than one half the shortest audio wavelength of the signal provided to the second set of drivers (as defined by the low pass filter frequency target, LPFFT). By providing a continuous range of signal to at least one driver set, the artifacts associated with systems that utilize a crossover are substantially minimized while the benefits of coupled drivers are optimized. By maintaining closely spaced transducers and small dc relative to shared frequency wavelength the transducers' acoustic outputs couple to produce a uniform and coherent presentation.

The frequency for the where the system transitions from utilizing two coupled driver sets to just the broad range driver set is determined based on a number of factors. Horizontal spacing between the vertical centers of the driver sets impacts the transition, and the columns of drivers are preferably placed as close as practical maximizing the frequency up to where signal coupling may occur. In addition to spacing, driver characteristics such as power handling and frequency response, as well as diffraction loss/baffle step of the system impact the targeted frequency for the transition. The characteristics of the filter (order and corner frequency) modifying the signal provided to the second driver set also impacts the targeting of transition frequency. A first order filter provides a shallow 6 dB per octave attenuation slope and a predictive response less affected by impedance variation as per higher order filters. Higher order filters provide steeper slopes that would more quickly attenuate shared frequency reproduction above the filter target. The loudspeaker cabinet also impacts the target due to diffraction loss/baffle step response as the size of the baffle (speaker) becomes significant in terms of frequency wavelength. At high frequencies, sound waves radiate narrowly as such energy is propagated forward of the speaker (into half space). At lower frequencies, the sound waves radiate around the speaker (into full space) and as the forward energy density is reduced and can have an impact of 3 to 6 dB (depending on speaker design and placement).

The disclosed speaker system may be utilized with both large column arrays and smaller systems that focus on the voice range of frequencies. The speaker system may be utilized by itself as the only source of sound, or the disclosed system may be utilized in combination with a supplemental frequency system, such as a subwoofer or super tweeter.

The present invention is applicable to any wave producing device, and is well suited for use in connection with, among others, studio, stage, and home audio systems.

Shown in FIG. 1 is a simplified example of the speaker system 5 with a first vertical column 10 positioned adjacent to a second vertical column 15 in a speaker cabinet 20. The first vertical column 10 includes two transducers 10*a* through 10*b* of substantially uniform size and frequency response.

The transducers of the first vertical column 10 are larger than the transducers of the second vertical column 15 and are able to more efficiently reproduce audio frequencies in the lower range of human hearing. The smaller transducers of the second vertical array 15 have a smaller radiating area, are lighter, and are able to more efficiently reproduce the audio frequencies at the higher end of human hearing. The terms first and second are merely identifiers, and the transducers of the second vertical column may be larger and better able to reproduce low frequencies than the transducers of the first vertical column.

At low frequencies, below the critical frequency, the drivers of the first vertical column 10 and the second vertical column 15 are all loaded and effectively couple and act as a single driver to reproduce low frequency sound. Above the critical frequency, only the drivers of the second vertical column 15 are loaded, maintaining the benefits of a vertical line array. The speaker system continually transitions between operating above the critical frequency and below the critical frequency. It should be appreciated that the "transitions" of the disclosed speaker system are distinct from the "crossovers" found in traditional systems that send the high frequency component of a signal to a smaller/tweeter driver and the low frequency component of the signal to a larger/woofer driver. A crossover is a less than perfect transition of frequency reproduction from one driver to another. Over this range both drivers are sharing the signal and crossover topologies add phase shifts, peaks, and dips. Compounding the issues with crossovers is that they often occur within the most sensitive range of human hearing.

In contrast to the crossovers of previous systems, in the transitions of the current system the full range driver column is does not receive a frequency-attenuated signal and the low frequency driver column engages to supplement rather than replace the full range driver column. In an exemplary embodiment of the invention the low frequency driver begins to engage at a frequency that is outside of the most sensitive hearing range where it couples with the full frequency range column such that distortions are minimized relative to a standard crossover system.

The transducers of the first vertical column are spaced such that the sound waves created by each of the transducers constructively interfere with each other and focus the sound pressure of the system in front of the vertical column. The constructive interference of the drivers is additive up to 6 dB relative to a single driver, and the number of drivers may be varied to optimize sound propagation for a particular listening environment. Similar to the first vertical column 10, the second vertical column 15 also has two transducers 15*a*-15*b* that are of substantially similar size and frequency response. Like the first vertical column 10, the second vertical column 15 of drivers also constructively focuses the sound pressure of the vertical column. In addition to on axis constructive interference, destructive interference occurs off axis thereby reducing the amount of sound that directed toward the ceilings and floors of the venue around the speaker system. Sound that bounces off the ceiling/floor travels a longer path to the listener arriving at a later time than the direct sound from the drivers, causing distortions in the sound presentation.

The distance 30 for the speaker system is calculated as the horizontal distance from the acoustic center line of the first vertical column 10 to the acoustic center line of the second vertical column 15. Even if there was an elevation change between the average acoustic centers, only the horizontal displacement between the speakers is used in measuring the distance.

The cabinet holding the transducers may also include features or functionality to help focus and/or couple the sound propagation from the various transducers, such as baffle design, waveguides, and/or horn designs, in view of specific listening environment and sound presentation goals. The loudspeaker system may be housed in a multitude of enclosures, such as those that are sealed, vented/ported, have an open back, and those that are open baffle.

Figure 2A:
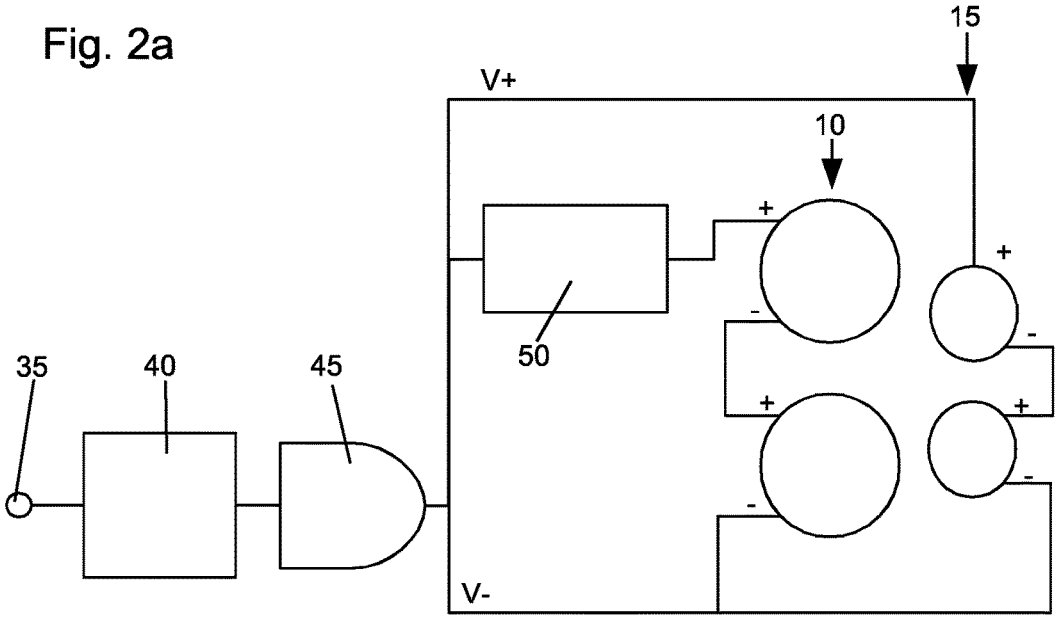
FIG. 2*a* is a wiring schematic of a dual vertical column speaker system.

FIG. 2*a* shows a simplified electronic schematic of the speaker system of FIG. 1. The electronic design is just one example of how the system may be configured, and is not inclusive of the possible configurations that are within the scope of the present invention. For example, the number of drivers in each column may be expanded beyond the two shown in FIG. 2*a*. A signal source 35 provides an audio signal to an optional audio processor 40 (or signal processor). In the illustrated example, a key functionality is to allow a user to electronically adjust the relative amplitudes of selected frequencies of the audio signal provided by the signal source 35. In other embodiments, the audio processor may be providing an audio signal to multiple speaker systems, such as in a dual cabinet stereo configuration or a multiple cabinet surround sound theater system. For multiple cabinet systems, the audio processor may adjust the amplitude of the audio signal provided to each cabinet and may also frequency delay the signal provided to each cabinet to compensate for distances between a user and the various speaker cabinets. A low pass filter 50 modifies the signal provided to the drivers of the first vertical column.

An optional signal amplifier 45 receives the signal from the audio signal processor and amplifies the signal such that there is an appropriate level of signal provided to each transducer. While the signal amplifier is optional, it is expected that in most implementations of the system there will be a need to amplify the sourced signal.

The signal amplifier 45 provides an audio signal to both the first and second vertical columns that are connected in parallel. In the illustrated example, there are two vertical columns connected in parallel, however it should be appreciated that three or more vertical columns may be connected in parallel. Additionally, multiple sections of a single vertical column may also be connected in parallel. For example, if a vertical column with a particularly large number of transducers were to be used, then portions of a single column may be connected in parallel to ensure an appropriate voltage drop across each transducer, and an appropriate resistance/load to the amplifier. While the representative schematic shown in FIG. 2*a* shows the drivers wired in series and parallel, the configuration of FIG. 2*a* is just one embodiment and is not inclusive of all the wiring configurations that are within the scope of the present invention.

Figure 2B:
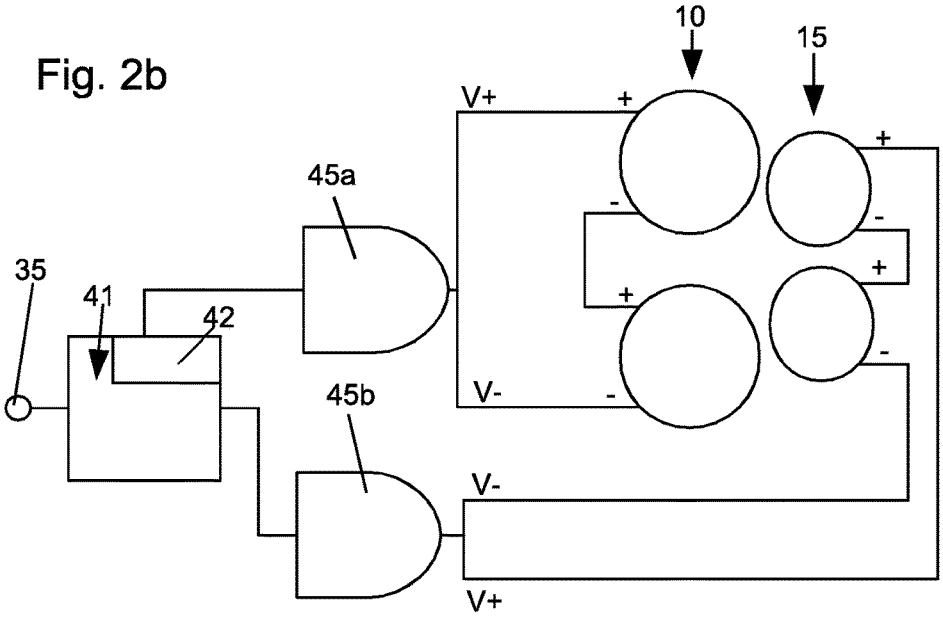
FIG. 2*b* is a wiring schematic of a dual vertical column speaker system.

FIG. 2*b* illustrates a second embodiment where the signal source 35 provides a signal to a signal processor 41 (SP) that includes a low pass filter 42. The SP 41 provides a frequency attenuated signal to a first signal amplifier 45*a* while a non-frequency-attenuated signal is provided to a second signal amplifier 45*b*. The amplifiers 45*a*, 45*b* do not significantly attenuate specific frequencies so the second vertical column 15 of drivers receives a non-frequency-attenuated signal from the signal processor 41.

In these two illustrated examples, the transducers of the first vertical column are larger than the transducers of the second vertical column and are adapted to more efficiently reproduce sounds in the lower frequency bands.

The MLPFF (maximum low pass filter frequency) −3 dB corner cutoff of the low pass filter 50 (42 in FIG. 2*b*) for the first vertical column is selected based on the horizontal distance 30 between the acoustic centers of the first and the second vertical driver columns. In an exemplary embodiment of the invention, this maximum corner frequency is established wherein its wavelength is twice this distance 30. The chart below illustrates some exemplary relationships between the −3 dB maximum corner cutoff frequency of the low pass filter (50 and 42) and the distance 30 at sea level and 72° Fahrenheit.

| dc Acoustic Center Distance (in) | MLPFF −3 dB (Hz)≤ | f wavelength (in) |
|---|---|---|
| 17.0 | 400 | 33.9 |
| 8.5 | 800 | 17.0 |
| 5.7 | 1,200 | 11.3 |
| 4.2 | 1,600 | 8.5 |
| 4.0 | 1,700 | 8.0 |
| 3.4 | 2,000 | 6.8 |
| 3.25 | 2,100 | 6.5 |
| 2.8 | 2,400 | 5.7 |
| 2.4 | 2,800 | 4.8 |
| 2.1 | 3,200 | 4.2 |
| 2.0 | 3,400 | 4.0 |

The low pass filter −3 dB values in the previous chart are based on the calculation S/(2×dc)=−3 dB corner frequency, where S is the speed of sound and dc is the horizontal distance between column acoustic center lines (30 FIG. 1). It should be appreciated that the values listed above are not inclusive of all low pass filter frequencies that may be selected and still be within the scope of the present invention. In some examples this corner frequency may be extended to S/dc (matching corner frequency up to wavelength of dc). In exemplary examples, the −3 dB corner cutoff frequency of the low pass filter selected is ≤S/(2×dc). The −3 dB corner cutoff frequency of the low pass filter may be set significantly less than the MLPFF. As an example, a system with a dc of 3.25 inches may use 760 or 380 Hz as the −3 dB while a system with a dc of 4.0 inches may use a −3 dB of 400 or 800 Hz.

In further alternate embodiments of the invention, the −3 dB corner cutoff frequency of the low pass filter is determined based on the following relationship:

$$\frac{Lf \times S}{dc} \leq -3\text{ dB} \leq \frac{Hf \times S}{dc}$$

wherein Lf is a unitless low frequency factor, S is the speed of sound (approximately 13,560 inches per second at 72 degrees F. at 1 atmosphere of pressure), dc is the distance between acoustic centers of the first and second vertical columns, and Hf is a unitless high frequency factor. In one embodiment Hf is less than or equal to 1.25 and Lf is greater than or equal to 0.25. By minimizing Hf the coupling between the two vertical columns is improved. By maximizing Lf the dynamic range of the first vertical column is maximized. While Lf cannot be greater than Hf, the inventor contemplates several possible bands of −3 dB corner cutoff frequency that may be utilized. When multiple cabinets of vertical columns are utilized (as with a stereo system, or a surround sound home theater system), in exemplary embodiments all of the −3 dB corner cutoff frequencies of the low pass filters would fall within one of the following ranges:

| | Lf | Hf |
|---|---|---|
| Example 1 | 0.98 | 1.02 |
| Example 2 | 0.95 | 1.00 |
| Example 3 | 0.90 | 1.00 |

-continued

| | Lf | Hf |
|---|---|---|
| Example 4 | 0.80 | 1.05 |
| Example 5 | 0.80 | 1.10 |
| Example 6 | 0.47 | 0.51 |
| Example 7 | 0.45 | 0.50 |
| Example 8 | 0.45 | 0.55 |
| Example 9 | 0.40 | 0.55 |
| Example 10 | 0.47 | 1.00 |
| Example 11 | 0.45 | 1.05 |

In another embodiment utilizing multiple speaker cabinets, the −3 dB of the low pass filter of a first speaker cabinet (or filters of a series of cabinets) is between an 0.45 Lf and a 0.5 Hf while a second set of low pass filters of a second set of speaker cabinets has a −3 dB that is between 0.9 Lf and 1.00 Hf. In one embodiment, the transducers associated with Lf and Hf between 0.45 and 0.50 are larger or smaller than the transducers associated with Lf and Hf between 0.90 and 1.00, such as might be found in the center/left/right speakers of a home theater system compared to the surround sound left/right/rear speakers.

As shown in FIG. 2*a*, there is a low pass 50 filter between the source (signal amplifier 45)(or audio input) and the first vertical column 10, however the second vertical column 15 receives a full range "non-frequency-attenuated signal" from the audio input source (signal amplifier 45). In FIG. 2*b*, the "audio input" is located within the signal processor 41 at the point where the signal is split and a portion is sent to signal amplifier 45*b* and a second portion passes through a low pass filter 42. The term non-frequency-attenuated signal is herein defined to be a signal from the source that that has not been processed through a low-pass, high-pass, band-pass, or other filter that selectively attenuates signals after it passes from the source. If a first source passes a signal to a second source via a low pass filter, and the second sources passes the signal directly to a driver, the driver receives a non-frequency-attenuated signal from the second source because there was no frequency attenuation between the second source and the driver. In the previous example, the driver does not receive a non-frequency-attenuated signal from the first source because the signal passes through a low pass filter between the first source and the driver. While wires and standard resistors do attenuate certain frequencies more than others (100 GHz vs. 1 kHz, for example) to some degree, these types of electrical components are specifically included in the components that can provide a non-frequency-attenuated signal to a transducer. Additionally, the "frequency" component of the term non-frequency-attenuated generally refers to the frequencies that are within the range of standard human hearing. The term low pass filter is used to refer to a filter that attenuates high frequencies, and the term is broad enough to encompass band pass filters that pass a low frequency band. For example, a band pass filter that passes frequencies between 10 Hz and 200 Hz is herein defined to be a low pass filter.

By providing the full range of frequencies to the full range vertical column 15, the artifacts associated with standard systems using a woofer/tweeter crossover are reduced or eliminated. Additionally, by receiving the full range (the lower and higher frequencies) from the signal amplifier, the transducers of vertical column 15 are able to acoustically couple with the transducers of the frequency-attenuated vertical column 10 to act in concert to produce lower frequency sounds.

FIGS. 3*a*, 3*b*, 3*c*, 4, 5*a*, and 5*b* illustrate how the baffle in a speaker cabinet may be designed to utilized the areas receiving the fully coupled sound wave propagation and directional propagation (herein referred to as the optimal listening area) from a speaker cabinet while also adjusting the horizontal distance between acoustic centers of the speakers. These various configurations allow sound system designers the flexibility to optimize sound propagation for a particular listening environment.

Figure 3C:
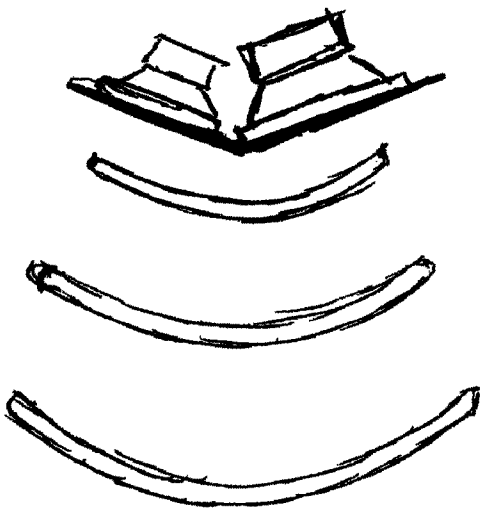
FIG. 3*c* is a top plan view illustrating the sounds waves propagating from transducers with convex baffle between two vertical columns.
Figure 3B:
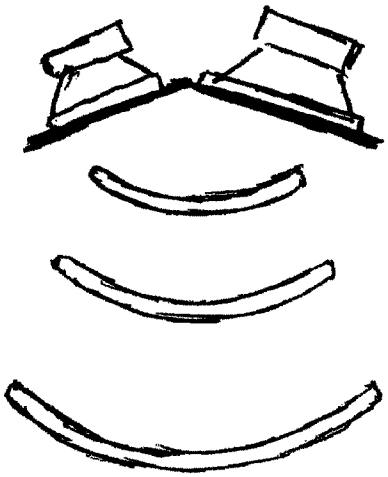
FIG. 3*b* is a top plan view illustrating the sounds waves propagating from transducers with concave baffle between two vertical columns.
Figure 3A:
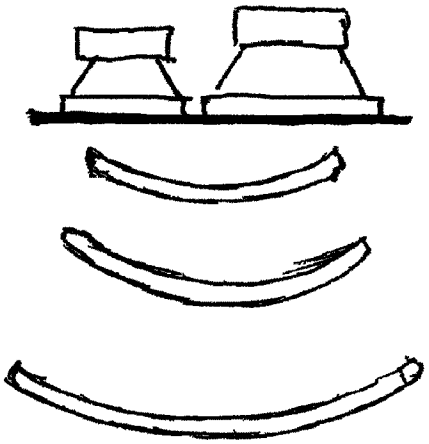
FIG. 3*a* is a top plan view illustrating the sound waves propagating from transducers of two vertical columns with a flat baffle.

In FIG. 3*a*, the transducers have a flat baffle such that the front faces of the transducers are approximately parallel and/or coplanar with each other. In FIG. 3*b*, the front faces of the transducers have a concave baffle. In addition to optimizing sound propagation for the listening environment, the use of a concave baffle for the transducers allows for the acoustic center lines of the transducers to be positioned closer together than in a flat baffle configuration such as seen in FIG. 3*a*. In one embodiment of the invention, the transducers of the first vertical column have diameters of $D_1$, the transducers of the second vertical column have diameters of $D_2$, and the transducers are baffled such that $dc \leq (D1+D_2)/2$ By utilizing a smaller distance between acoustic center lines (dc) driver coupling can occur out to higher frequencies, as such a higher −3 dB frequency may be selected for the low pass filter modifying the audio signal being provided to one of the vertical driver columns.

Figure 4:
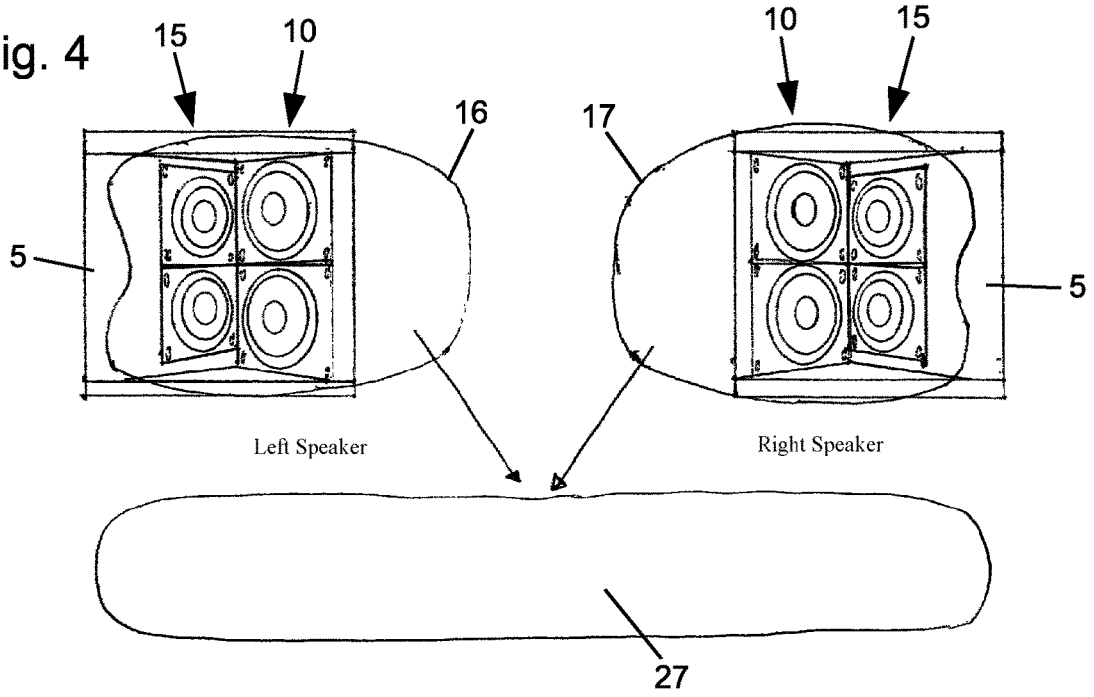
FIG. 4 shows a two speaker cabinet system; each cabinet having concave baffles directing sound towards a listening location.
Figure 5A:
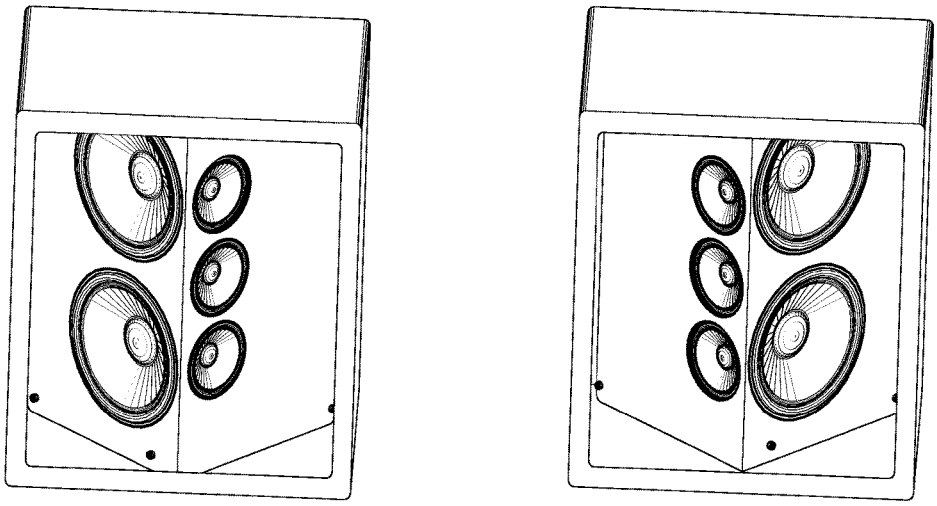
FIG. 5*a* is a perspective view of a two speaker cabinet system, each cabinet having convex baffles directing sound towards an optimal listening location.
Figure 5B:
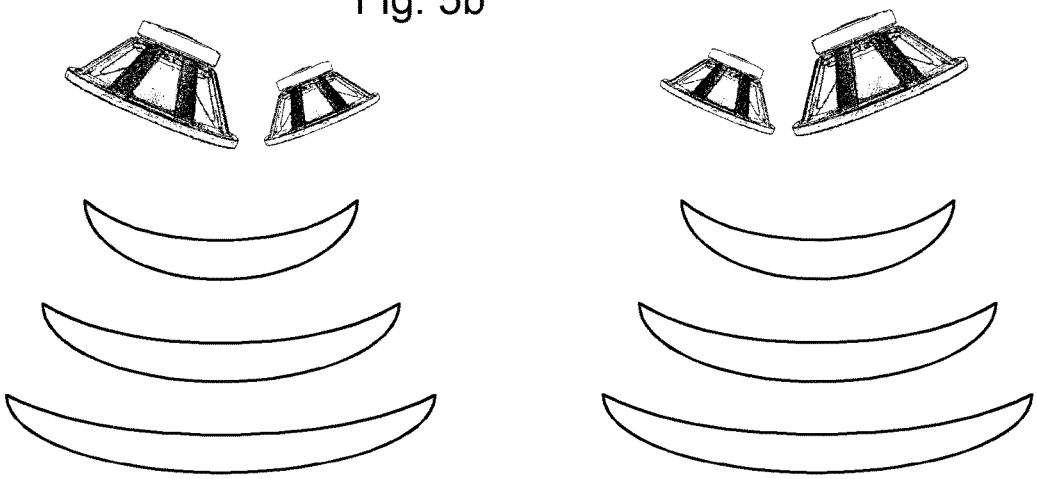
FIG. 5*b* is a top plan view of the system of FIG. 5*a*.

FIG. 4 illustrates two speaker cabinets, each including two vertical columns with a concave baffle. The output from the vertical column 15 of smaller transducers in this embodiment couple with output from the vertical column 10 transducers to create a controlled and focused presentation (16, 17) from each speaker 5 as it extends towards the listening area 27. Wherein each speaker 5 has a column of transducers operating over a full range of octaves augmented by an adjacent column operating over all but the higher frequency octaves. FIGS. 5*a* and 5*b* illustrate an alternate embodiment with two speaker cabinets, each including two vertical columns with a convex baffle.

Figure 6:
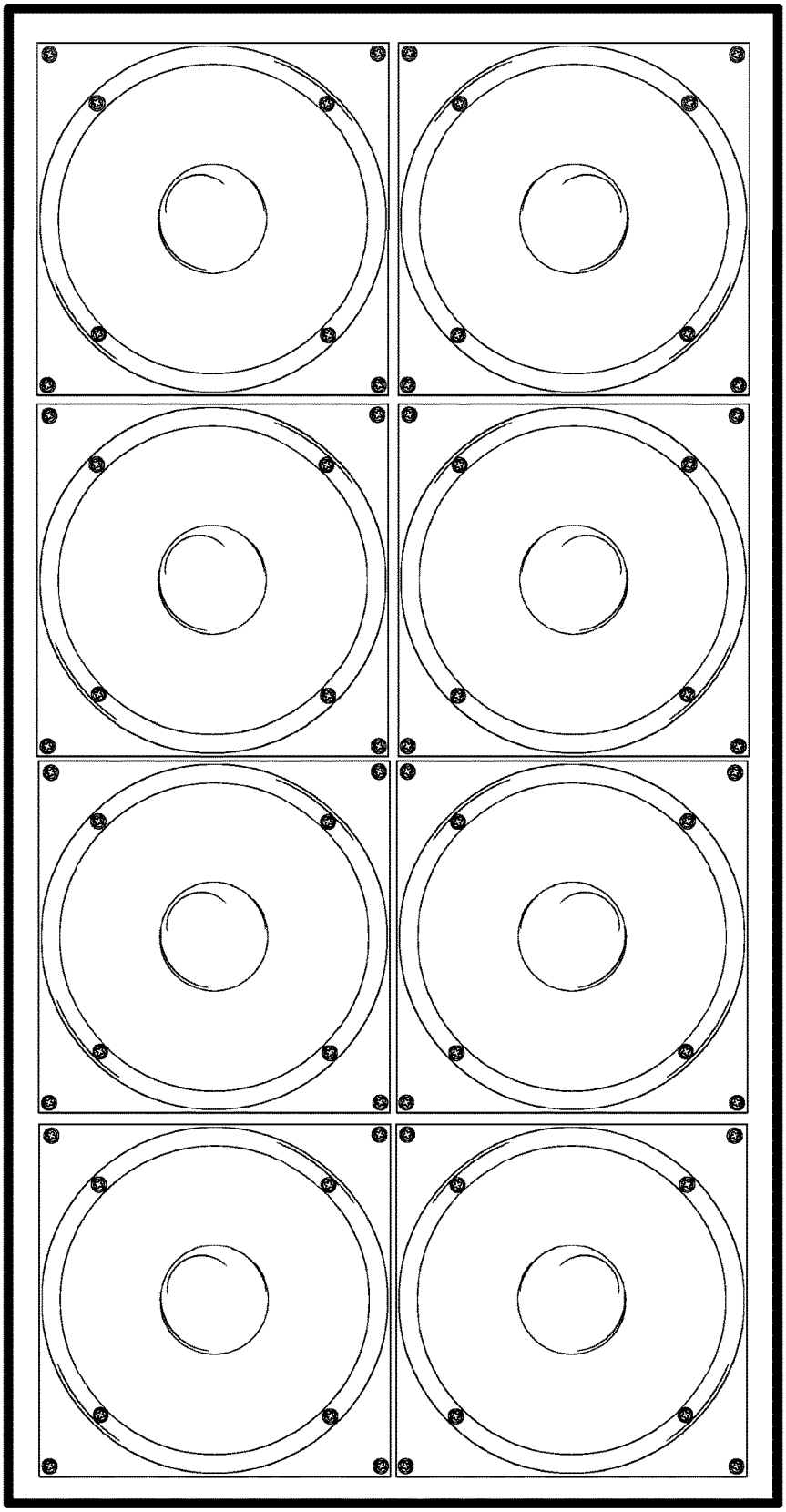
FIG. 6 illustrates a dual vertical column system where the transducers of the first column are uniform with the transducers of the second column.

FIG. 6 illustrates an alternate embodiment of a speaker cabinet with a first vertical column and a second vertical column where the transducers of both the first and second vertical columns have substantially the same size and frequency response. While the first and second vertical columns have nearly identical transducers, in the illustrated example only the first vertical column receives the full spectrum of audio signals while a low pass filter conditions the audio signals provided to the second vertical column.

Figure 7:
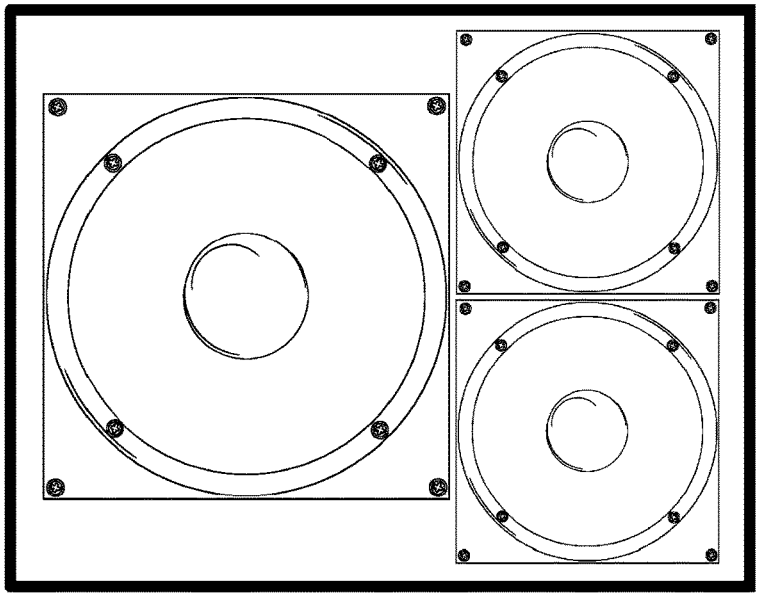
FIG. 7 shows a three transducer speaker system with a large transducer positioned adjacent to a column having two smaller transducers.
Figure 8:
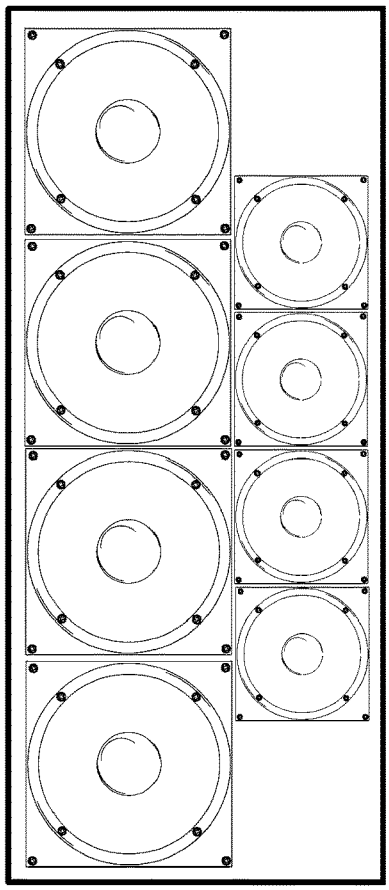
FIG. 8 shows an eight-transducer speaker system with a larger four-transducer column positioned adjacent to a smaller four-transducer column.
Figure 9:
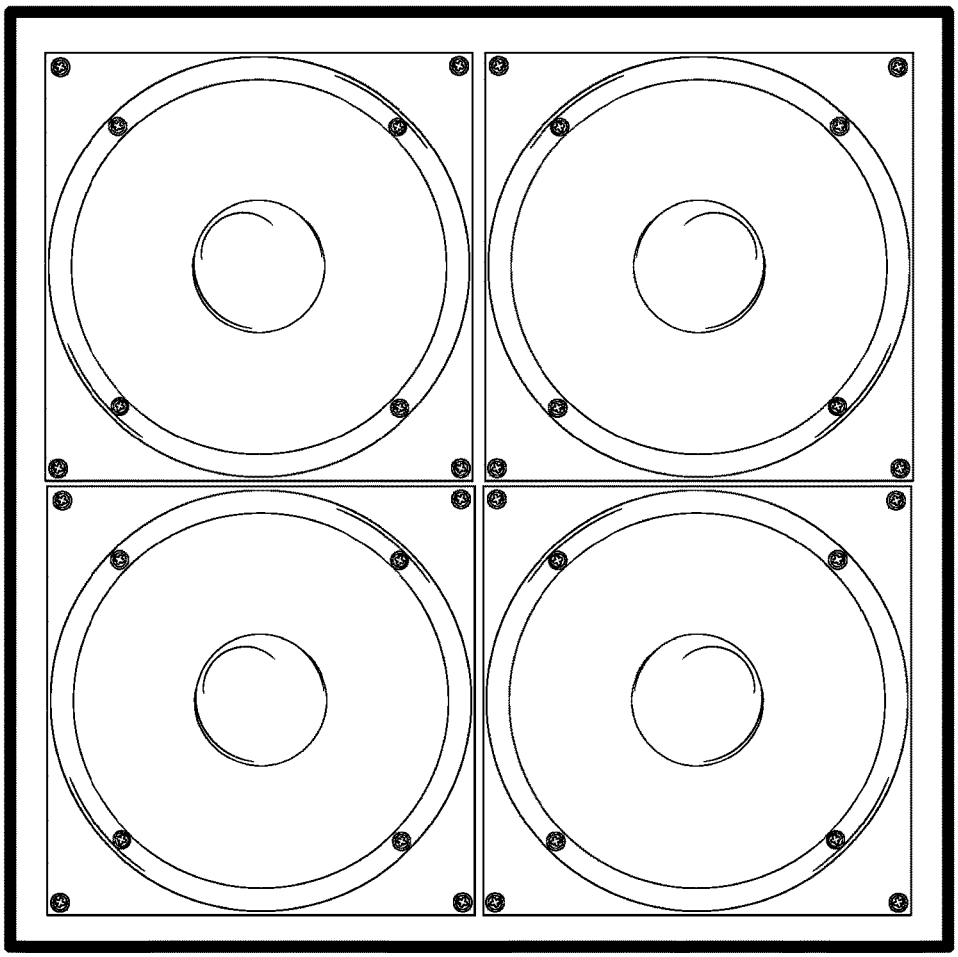
FIG. 9 shows a four-transducer speaker system with a first two-transducer column positioned adjacent to a second two-transducer column.

FIGS. 7 through 12 illustrate various other embodiments of speaker cabinets. While taller vertical columns, such as those shown in FIGS. 6 and 8, will generally provide optimized constructive and destructive interference, the more compact cabinets can be used for voice only systems or systems for small presentation areas. For example, the compact speaker cabinets shown may be used in studios as monitors, in home stereos, in surround sound components of a theater system. In one embodiment, speaker cabinets similar to those shown in FIG. 8 are used for the front left and front right channels, while the speaker cabinets shown in FIG. 1 or 7 are utilized for the center, surround channels of the system.

FIGS. 10*a* and 10*b* show an alternate embodiment of the invention where the speaker cabinet includes a front vent 70 through which the output of the first vertical column emanates. In the illustrated example, the vent directs the sound waves from the first vertical column through a vented position that is closer to the second vertical column and effectively reduces the horizontal distance dc between acoustic centers of the two vertical columns, 65 relative to 60. 60 is the horizontal face distance between the transducer centers of the first and second vertical columns, and 65 is the distance between the effective acoustic centers (adjusting for vents and waveguide) of the first and second vertical columns. In such systems, 65 is used as dc to calculate corner filter frequencies. By reducing the effective horizontal distance between acoustic centers, coupling can occur out to higher frequencies and higher −3 dB corner frequency may be selected for the low pass filter.

In one embodiment of the invention the −3 dB corner frequency of the low pass filter is:

$$\frac{S}{2\times d_{actual}} \leq -3\text{ dB} \leq \frac{S}{2\times d_{effective}}$$

wherein S is the speed of sound (approximately 13,560 inches per second at 72 degrees F. at 1 atmosphere of pressure), $d_{actual}$ 60 is the horizontal face distance between the transducer centers of the first and second vertical columns, and is the $d_{effective}$ 65 is the distance between the effective acoustic centers (adjusting for vents and waveguide) of the first and second vertical columns. As shown in FIG. 10*b*, the horizontal face distance 60 the horizontal distance between acoustic centers as measured parallel to the user facing side of the speaker cabinet.

FIGS. 11 and 12 illustrate examples of speaker systems used in combination with waveguides and/or horn configurations. FIG. 12 illustrates a first transducer column defining a first geometric transducer face plane 72 while a second transducer column defines a second geometric transducer face plane 73 that intersects the first geometric transducer plane 72 at an intersection angle 74. The geometric transducer face planes are coplanar with the outer circumferences of their respective transducer diameters, and in an exemplary embodiment the intersection angle is greater than 45 degrees and less than 135 degrees. FIG. 11 illustrates an example where the first and second transducer columns collectively define a geometric transducer face plane.

Figure 13:
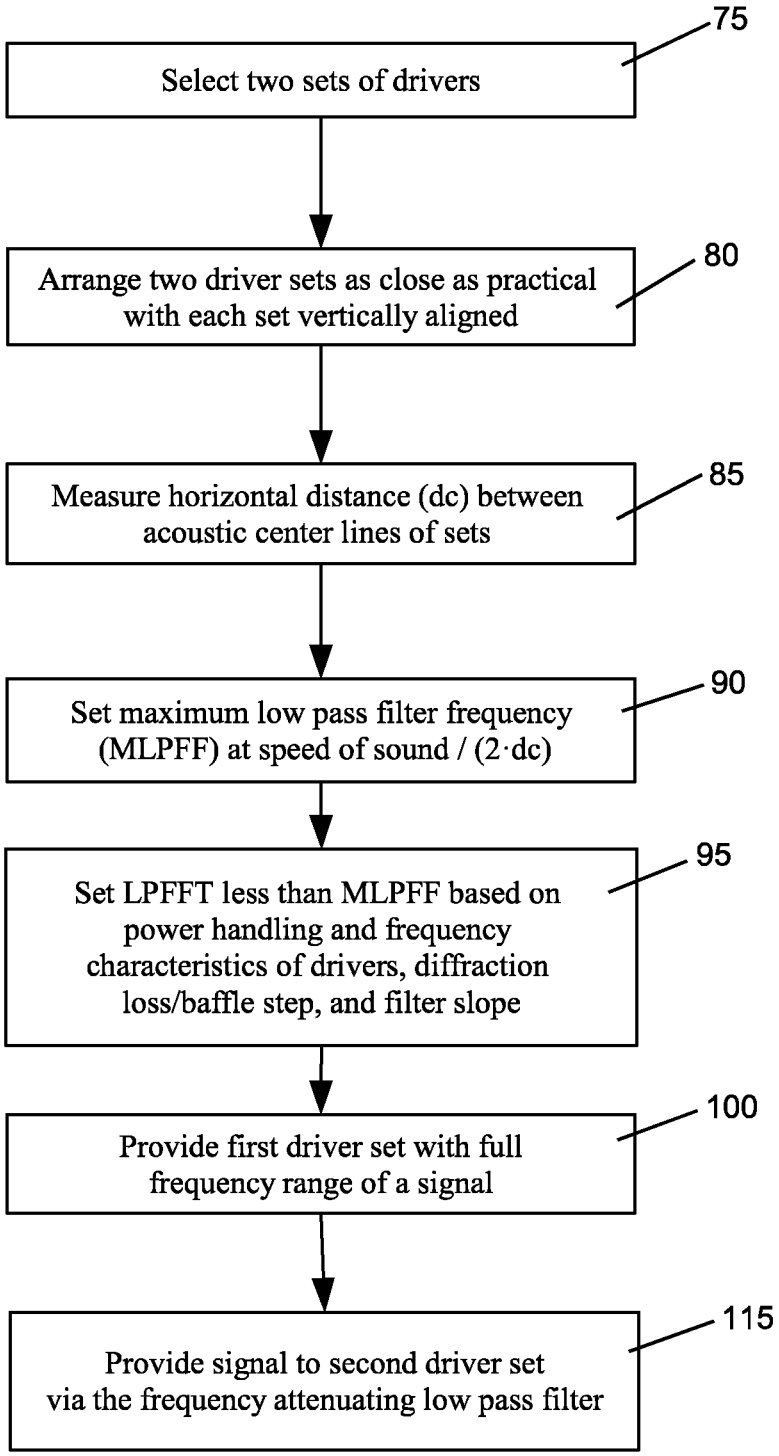
FIG. 13 illustrates an example of the design process of the speaker system.

FIG. 13 illustrates an example method of designing and producing a multi-driver array audio speaker system. At step 75, two sets of drivers are selected. As previously mentioned, the drivers within the first set may have response characteristics that are the same or different from the second set of drivers. While is it generally expected that each driver set will include at least two drivers, in some instances the second driver set will only include one driver.

At step 80, the vertically aligned drivers of the first set are placed as close as practical to the vertically aligned drivers of the second set. In some instances the drivers of the two sets will all be positioned facing directly forward within a speaker cabinet, while in other instances the drivers may be angled with a baffle, incorporated as a waveguide, and/or vented system.

At step 85, the horizontal distance (dc) between the acoustic centers of the speaker sets is measured (as defined by vents and/or waveguides where employed in such systems). As previously stated, the acoustic centers of a vertical speaker set is a vertical line rather than a point.

At step 90, the maximum low pass filter frequency (MLPFF) is calculated based on the speed of sound divided by twice the measured horizontal distance.

At step 95, a low pass filter frequency target (LPFFT) with a −3 dB corner frequency less than the MLPFF is selected for the system. While a speaker system that utilizes the maximum low pass filter frequency in the low pass filter is within the scope of the invention, in an exemplary embodiment the LPFFT has a −3 dB at less than the MLPFF. This LPFFT is selected based upon power handling and frequency characteristics of the drivers, diffraction loss/baffle step of the system, and filter slope of the low pass filter selected.

As an example; a 12 inch wide baffle speaker system with a dc of 3.25 inches has a MLPFF of 2100 Hz. Even if the two adjacent driver sets have a high inherent MLPFF (2100 Hz in this example), the LPFFT may be best set below this level to balance out the system's frequency response and power handling characteristics. Additionally, LPFFT is further adjusted based on the diffraction loss/baffle step of the system. At low frequencies, the sound waves radiate in full space around the speaker. At high frequencies (relative to the baffle size) the sound waves radiate narrowly in front of the speaker (known as half space). The transition between radiating around the speaker cabinet and a focused wave occurs when the frequency generated becomes large relative to the baffle size and is such that the energy density of the lower frequencies is reduced. This can have an impact of 3 to 6 dB (depending upon speaker design and room placement), generally calculated at a frequency of 380 Hz divided by the baffle width in feet. As such the LPFFT may be targeted to accommodate and offset the baffle step at 380 Hz in this example, and roll off towards the MLPFF, supporting the low frequency output of the system.

The LPFFT additionally takes into account the expected slope of the low pass filter to be used. For example, if it is expected that a first order filter is to be utilized, the LPFFT may vary relative to a system that would use a second order low pass filter.

At step 100, the system is configured to provide the first driver set with the full frequency range of a signal. At step 115, the system is configured such that the second driver set receives the signal after it has been frequency attenuated by the selected LPFFT low pass filter.

It should be understood that the programs, processes, methods and system described herein are not related or limited to any particular type components unless indicated otherwise. Various combinations of general purpose, specialized or equivalent components may be used with or perform operations in accordance with the teachings described herein. In view of the wide variety of embodiments to which the principles of the present invention can be applied, it should be understood that the illustrated embodiments are exemplary only, and should not be taken as limiting the scope of the present invention. For example, more, fewer or equivalent elements may be used in the embodiments or multiple speakers can be combined into a larger system. Sequencing of frequencies among the drivers such as via consecutively stepped low-pass filters may also be incorporated into the system. Pairing with low frequency speakers may be employed, as with the systems focused on the voice range and/or larger system.

I claim:

1. A loudspeaker system comprising:

a first vertical driver column and a second vertical driver column in a first speaker cabinet having a first audio signal input;

a first electric circuit with the first vertical driver column electrically connected to the first audio signal input, the second vertical driver column electrically connected to the first audio signal input via a first low pass filter, the first low pass filter having a first −3 dB corner cutoff frequency (−3 dB), wherein the first electrical circuit is configured to provide the first vertical driver column with a first non-frequency-attenuated signal from the first audio signal input;

the first vertical driver column having a first acoustic center line;

the second vertical driver column having an output at a second acoustic center line located a first horizontal face distance (dc) from the first acoustic center line; and $$-3d \leq \frac{S}{d}$$

wherein S is the speed of sound.

2. The loudspeaker system of claim 1 wherein the first vertical driver column includes a plurality of drivers;

the first electric circuit includes the first vertical driver column connected in parallel with the second vertical driver column, the plurality of drivers of the first vertical driver column connected in series, and the first low pass filter connected series with the second vertical driver column; and $$-3d \leq \frac{S}{2 \times d}.$$

3. The loudspeaker system of claim 1 wherein the output of the second vertical driver column is located at a speaker cabinet vent;

the second vertical driver column has a third acoustic center line located at the second vertical driver column; and the first acoustic center line and the third acoustic center line are separated by a second horizontal face distance that is greater than dc.

4. The loudspeaker system of claim 3 wherein $$\frac{S}{2 \times d_1} \leq -3d \leq \frac{S}{2 \times d_2}$$

where $d_1$ is the second horizontal face distance between the first acoustic center line and the third acoustic center line and $d_2$ is the first horizontal face distance.

5. The loudspeaker system of claim 1 wherein the dc and the −3 dB are a pairing selected from a group of pairings consisting of:

17 inches and 400 Hz,
8.5 inches and 800 Hz,
5.7 inches and 1200 Hz,
4.2 inches and 1600 Hz,
3.2 inches and 2100 Hz,
2.8 inches and 2400 Hz,
2.4 inches and 2800 Hz,
2.1 inches and 3200 Hz, and
2.0 inches and 3400 Hz.

6. The loudspeaker system of claim 1, wherein the first vertical driver column has a first number of drivers, the second vertical driver column has a second number of drivers, and the first number is greater than the second number.

7. The loudspeaker system of claim 6, wherein the second number is one.

8. The loudspeaker system of claim 1 wherein the dc and the −3 dB are a pairing selected from a group of pairings consisting of:

17 inches and 400 Hz,
8.5 inches and 800 Hz,
5.7 inches and 1200 Hz,
4.2 inches and 1600 Hz,
4 inches and 1700 Hz,
4 inches and 800 Hz,
4 inches and 400 Hz,
3.25 inches and 2100 Hz,
3.25 inches and 760 Hz,
3.25 inches and 380 Hz,
3.2 inches and 2100 Hz,
2.8 inches and 2400 Hz,
2.4 inches and 2800 Hz,
2.1 inches and 3200 Hz, and
2.0 inches and 3400 Hz.

9. The loudspeaker system of claim 1, wherein the first vertical driver column includes a first plurality of drivers having a first uniform diaphragm shape; and the second vertical driver column includes a second plurality of drivers having a second uniform diaphragm shape.

10. The loudspeaker system of claim 9, wherein the first uniform diaphragm shape and the second uniform diaphragm shape are the same.

11. The loudspeaker system of claim 1, wherein the speaker cabinet includes a wave propagation feature selected from a group consisting of:

the first and second vertical driver column having a concave baffle configuration, the first and second vertical driver column having a convex baffle configuration, a waveguide, a horn, and an open baffle.

12. The loudspeaker system of claim 1, further comprising the first speaker cabinet including a signal processor configured to receive a first signal from a signal source and provide a second signal to the first audio input, wherein the second signal is a frequency modified version of the first signal.

13. The loudspeaker system of claim 1, further comprising:

a third vertical driver column and a fourth vertical driver column in a second speaker cabinet having a second audio signal input, a second electric circuit with the third vertical driver column electrically connected to the second audio signal input;

the fourth vertical driver column electrically connected to the second audio signal input via a second low pass filter;

the second low pass filter having a second −3 dB corner cutoff frequency (−3 dB'), wherein the second electrical circuit is configured to provide the third vertical driver column with a second non-frequency-attenuated signal from the second audio signal input;

the third vertical driver column having a third acoustic center line;

the fourth vertical driver column having an output location at a fourth acoustic center line located a second horizontal face distance (dc') from the third acoustic center line, wherein $$-3d' \leq \frac{S}{dc'}$$

and an audio source configured to transmit a first audio signal to the first audio signal input of the first speaker cabinet, and a second audio signal to the second audio signal input of the second speaker cabinet.

14. The loudspeaker system of claim 13 wherein the first vertical driver column has a concave baffle to the second vertical driver column, the third vertical driver column has a concave baffle to the fourth vertical driver column, and the second and fourth vertical driver columns are located directly between the third and first vertical driver columns.

15. The loudspeaker system of claim 13 wherein the first speaker cabinet has a first front face coplanar with a second front face of the second speaker cabinet;

the first vertical driver column has a convex baffle to the second vertical driver column, the third vertical driver column has a convex baffle to the fourth vertical driver column, and the third and first vertical driver columns are located between the second and fourth vertical driver columns.

16. The loudspeaker system of claim 13 wherein

−3 dB is at least twice −3 dB' and dc' is at least twice dc.

17. The loudspeaker system of claim 13 wherein

−3 dB is equal to −3 dB' and dc' is equal to dc.

18. The loudspeaker system of claim 13 wherein the first audio signal is the same as the second audio signal.

19. The loudspeaker system of claim 13 wherein the audio source is a theater system receiver;

the first audio signal is sent from a first sound channel selected from a first group consisting of left, right, and center; and the second audio signal is sent from a second sound channel selected from a first group consisting of surround left, surround right, and rear.

20. A loudspeaker system comprising:

a first vertical transducer column and a second vertical transducer column both in a speaker cabinet;

a first electric circuit with a first electrical branch having a first plurality of transducers of the first vertical transducer column electrically connected in series, a second electrical branch having a first low pass filter connected in series with the second vertical transducer column, the first low pass filter having a first −3 dB corner cutoff frequency (−3 dB), and a first audio signal source, wherein the first electrical circuit is specifically configured to provide the first vertical transducer column with a non-frequency-attenuated signal from the first audio signal source, and provide the second vertical transducer column with a frequency-attenuated signal from the first audio signal source;

the first vertical transducer column having a first acoustic center line;

the second vertical transducer column having an output at a second acoustic center line located a first horizontal face distance (dc) from the first acoustic center line; and $$-3d \leq \frac{1.1 \times S}{2 \times dc}$$

wherein S is the speed of sound.

21. The loudspeaker system of claim 20, wherein the second electrical branch of the first electrical circuit consists of wiring, the first low pass filter, and a single transducer.

22. The loudspeaker system of claim 20, wherein the first vertical transducer column includes a plurality of transducers symmetrically located about a horizontal axis.

23. The loudspeaker system of claim 20, wherein the first vertical transducer column defines a first geometric transducer face plane, the second vertical transducer column defines a second geometric transducer face plane, the first geometric transducer face plane intersects the second geometric transducer face plane at an intersection angle, and the intersection angle is between 45 and 135 degrees.

24. The loudspeaker system of claim 20, wherein the first vertical transducer column includes a first plurality of transducers, the second vertical transducer column includes a second plurality of transducers, and the first plurality of transducers and the second plurality of transducers both are the same size and have the same frequency response.

25. A loudspeaker system comprising:

a first vertical transducer column and a second vertical transducer column;

a first electric circuit with a first electrical branch having a first plurality of transducers of the first vertical transducer column electrically connected in series, a second electrical branch having a first low pass filter connected in series with the second vertical transducer column, the first low pass filter having a first −3 dB corner cutoff frequency (−3 dB), and a first audio signal source, wherein the first electrical circuit is specifically configured to provide the first vertical transducer column with a non-frequency-attenuated signal from the first audio signal source, and provide the second vertical transducer column with a frequency-attenuated signal from the first audio signal source;

the first vertical transducer column having a first acoustic center line;

the second vertical transducer column having an output at a second acoustic center line located a first horizontal face distance (dc) from the first acoustic center line;

$$-3d \leq \frac{1.1 \times S}{2 \times dc}$$

wherein S is the speed of sound; and wherein the dc and the −3 dB are a pairing selected from a group of pairings consisting of:

3.25 inches and 2100 Hz, 3.25 inches and 760 Hz, 3.25 inches and 380 Hz, 4 inches and 1700 Hz, 4 inches and 800 Hz, and 4 inches and 400 Hz.

* * * * *